United States Patent [19]

Gray

[11] Patent Number: 4,776,310

[45] Date of Patent: Oct. 11, 1988

[54] YOKE WITH SLOTTED GUIDES AND SLIDES

[75] Inventor: Robert B. Gray, Belchertown, Mass.

[73] Assignee: R P & M Engines, Inc., Amherst, Mass.

[21] Appl. No.: 40,169

[22] Filed: Apr. 20, 1987

[51] Int. Cl.[4] ..... F02B 75/32

[52] U.S. Cl. ..... 123/197 AC; 123/196 R

[58] Field of Search ..... 123/197 AC, 197 R, 196 R, 123/197 AB; 74/594, 605

[56] References Cited

U.S. PATENT DOCUMENTS

| | | | |
|---|---|---|---|
| 995,948 | 6/1911 | Bracken | 123/197 AC |
| 1,349,660 | 8/1920 | Buhl | 123/197 AC |
| 3,570,459 | 3/1971 | Combs | 123/197 AC |
| 4,013,048 | 3/1977 | Reitz | 123/56 BC |
| 4,270,495 | 6/1981 | Freudenstein et al. | 123/197 AC |
| 4,301,776 | 11/1981 | Fleming | 123/197 AC |
| 4,598,672 | 7/1986 | Jayne et al. | 123/197 AC |

*Primary Examiner*—Charles J. Myhre
*Assistant Examiner*—David A. Okonsky
*Attorney, Agent, or Firm*—Paul M. Craig, Jr.; Walter W. Burns, Jr.

[57] ABSTRACT

An assembly for locking together in sliding relationship a yoke with a sliding block with one of the walls of a crankcase and having a channel apparatus isolated from the crankcase volume throughout rotation of the crankshaft for transmitting lubricant from an aperture in one of the walls of the crankcase via the yoke to lubricate the sliding block and crankthrow.

20 Claims, 8 Drawing Sheets

FIG.4
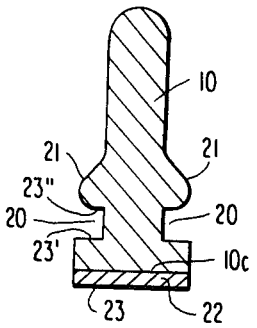
FIG.5
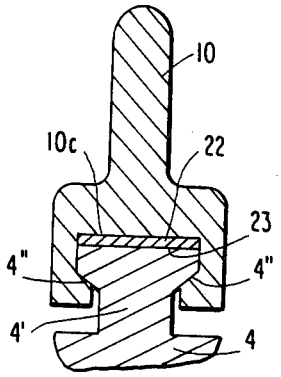
FIG.6
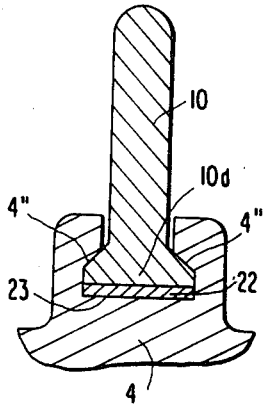
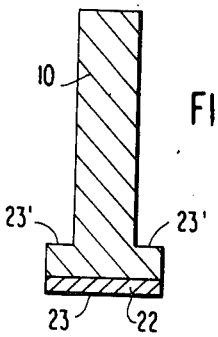
FIG.7
FIG.9
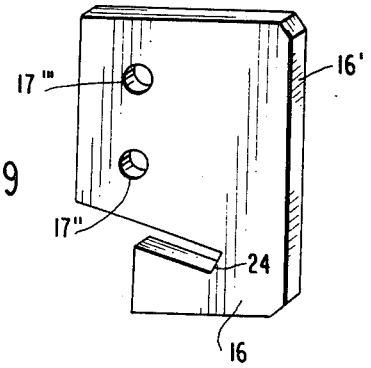
FIG.10
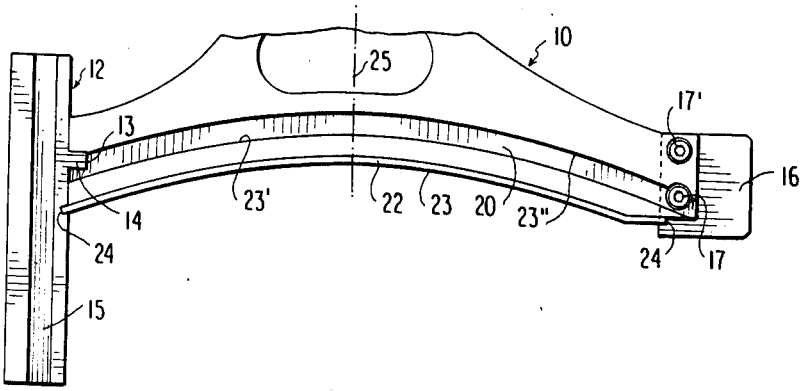

FIG. 15
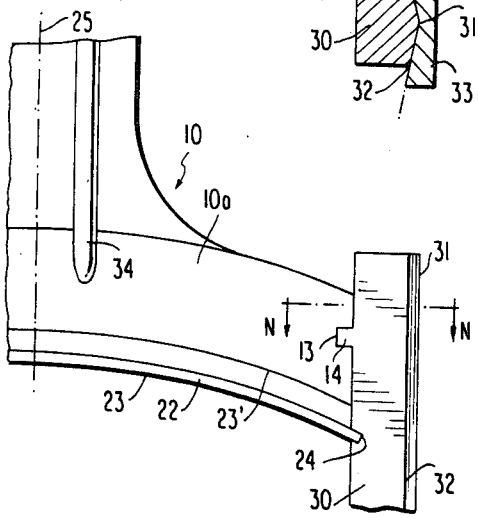
FIG. 15A
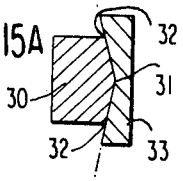
FIG. 43 PRIOR ART
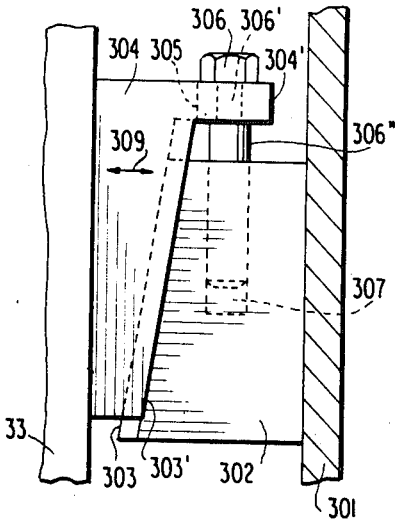
FIG. 16
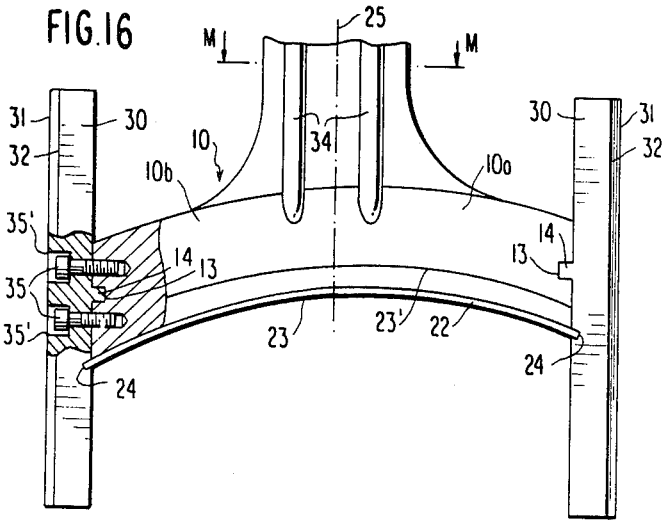
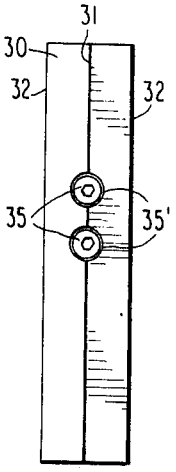
FIG. 17
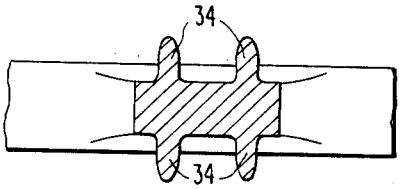
FIG. 16A FIG. 24
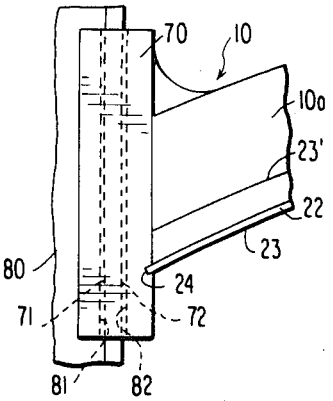
FIG. 25
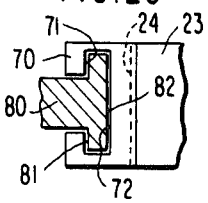
FIG. 26
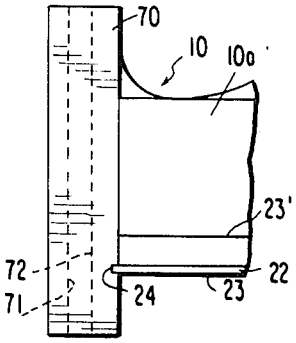
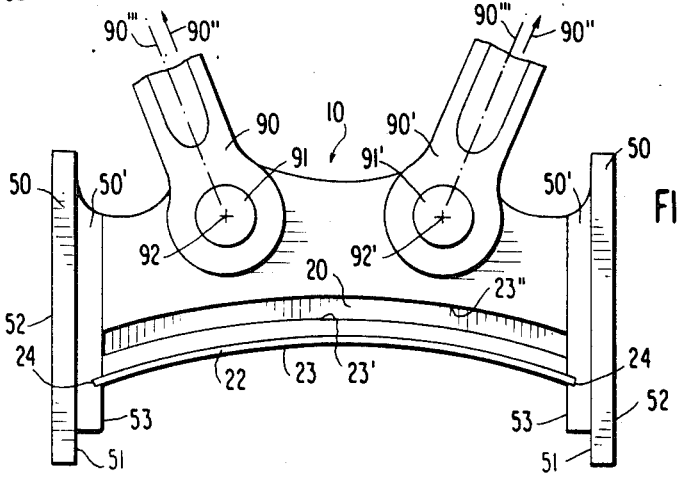
FIG. 27
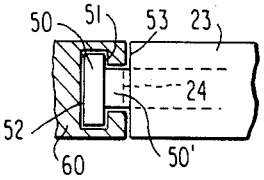
FIG. 28
FIG. 29
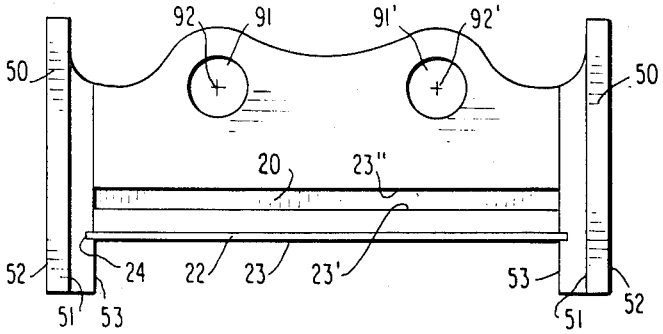

FIG.30
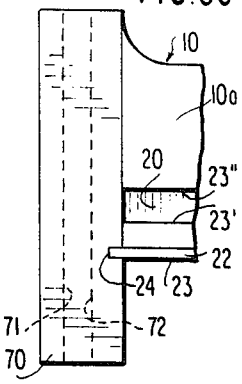
FIG.32
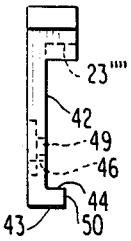
FIG.33
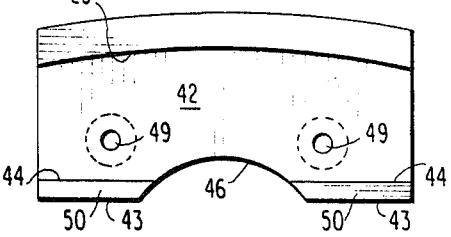
FIG.35
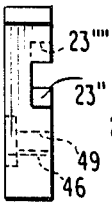
FIG.34
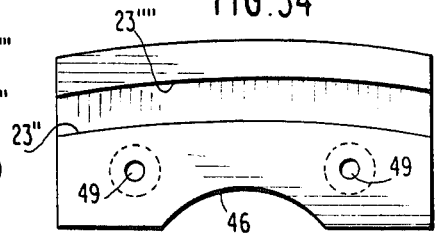
FIG.31
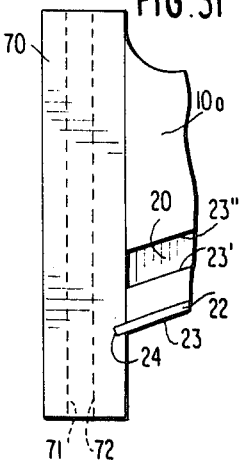
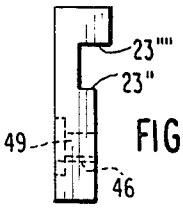
FIG.35A
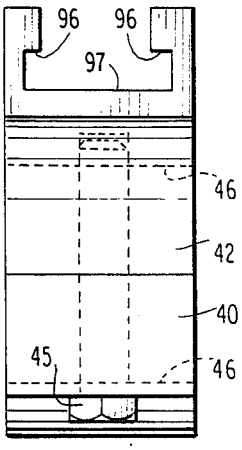
FIG.37
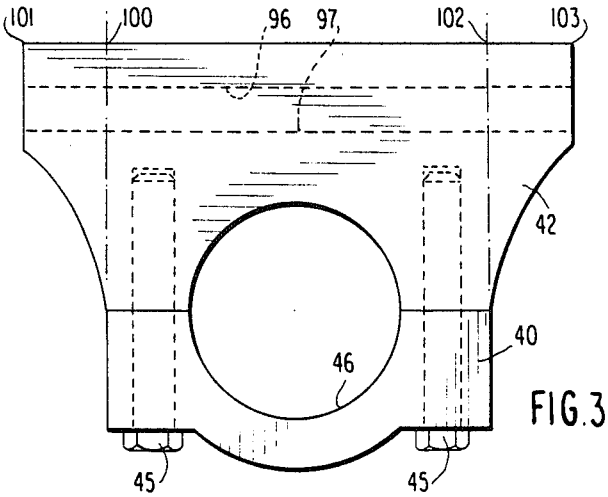
FIG.36

YOKE WITH SLOTTED GUIDES AND SLIDES

BACKGROUND AND SUMMARY OF THE INVENTION

The invention relates to a scotch yoke engine wherein the position of the yoke within the crankcase is determined by one or more guides mounted to the crankcase and the position of a sliding block slideably mounted on the yoke is also positioned by guides and with provision of lubrication of a sliding block without use of apertures in the crankshaft.

The invention has application to engines in general including internal and external combustion engines.

With regard to internal combustion engines, the invention has application to two stroke cycle and four stroke cycle engines, both in line and V-type. It has application to gasoline and diesel engines which may employ carburation or fuel injection including those wherein certain cylinders operate in engine mode while others operate in compressor mode.

PRIOR ART

U.S. Pat. No. 4,584,972 issued Apr. 29, 1986 to Jayne et al. discloses a scotch yoke engine with a yoke having an offset arcuate slot. The Jayne et al. patent and other disclosures in the prior art when operated under normal conditions may exhibit an expansion of the block due to the heat generated during operation, the expansion placing a significant load upon the surfaces of the slot within the yoke. This may result in excessive wear which enlarges the slot in turn resulting in improper positioning of the sliding block, a wedging action termed the "bureau drawer" effect.

The prior art also demonstrates significant complexity in yoke structure resulting in added cost of manufacture of the yoke and attendant members. For example, if spaced arcuate curved surfaces are employed in the slot within the yoke, the distances between the curved surfaces may be substantial and accordingly difficult may be experienced in establishing and maintaining the appropriate spatial relationship both between the arcuate surfaces during machining and during operation.

Yokes, in general, have significant mass and weight, all of which must be moved rapidly in a reciprocating motion which results in measurable energy loss due to the moving of the yoke mass.

Further difficulty has been experienced in satisfactorily lubricating sliding surfaces employed in scotch yoke engines.

OBJECTS OF THE INVENTION

Accordingly, it is an object of the invention to produce a scotch yoke engine which overcomes the difficulties which have been obtained in the prior art.

It is another object of the invention to produce a scotch yoke engine having fewer parts and exhibiting greater ease and lower cost of manufacture as to the yoke, sliding block and attendant members.

It is another object of the invention to produce a scotch yoke engine wherein the surfaces requiring precise alignment are disposed closer together than those of the prior art such that the tolerances for surfaces requiring precise alignment are established and maintained with greater ease and precision during manufacture and operation.

It is another object of the invention to produce a scotch yoke engine wherein the overall size, weight and mass of the yoke is reduced resulting in a reduction of vibration, noise and energy losss.

It is another object of the invention to produce a scotch yoke engine designed to eliminate cocking and jamming of a sliding block during its engagement with a yoke.

It is another object of the invention to produce a scotch yoke engine wherein the yoke is slidingly coupled to one side of a crankcase at the same time retained for sliding by an opposite side of the crankcase in a manner which admits of expansion of the yoke during operation.

It is another object of the invention to produce a scotch yoke engine wherein a sliding block is coupled to the yoke in sliding relationship, the yoke being configured such that the entire mass of the yoke is disposed between the sliding block and a piston.

It is another object of the invention to provide a scotch yoke engine wherein lubricant is introduced to yoke slides and a sliding block by means other than through a crankshaft.

It is another object of the invention to provide time controlled lubrication to yoke slides, sliding block and crankthrow in a scotch yoke engine.

BRIEF DESCRIPTION OF FIGURES

The foregoing objects and advantages of the invention will be apparent from a consideration of the drawings wherein like reference numerals identify like parts and wherein:

FIG. 4 shows a cross-section of the yoke along the line X—X in FIG. 2.

FIG. 5 shows a cross-section of another embodiment of the yoke of FIG. 2 along the line X—X, bearing surfaces having a keystone configuration with a land in a guide mounted to the crankcase wall.

FIG. 6 shows a cross-section of another embodiment of the yoke of FIG. 2 along the line X—X, with bearing surfaces having a keystone configuration with a land in an arm of a yoke.

FIG. 7 shows a cross-section of yet another embodiment of the yoke of FIG. 2 along the line X—X with a T cross-section.

FIG. 9 shows a perspective of a fin slide, as shown in FIG. 8, for mounting on a yoke.

FIG. 10 shows a yoke wherein the arcuate surface engaging the sliding block has a center of curvature substantially coincident with an axis of the cylinder.

FIG. 15 shows a partial view of a yoke having V-type slides at extremities of both yoke arms (only one shown) with an arcuate surface for a sliding block, the center of curvature being substantially coincident with an axis of the cylinder.

FIG. 15A shows a cross-section, along the line N—N in FIG. 15, of a yoke slide and crankcase guide having a V configuration.

FIG. 16 shows a yoke with an arcuate surface for the sliding block having V-type guides mounted at both yoke arm extremities, with center of curvature of the arcuate surface offset from the cylinder axis.

FIG. 16A shows a cross-section of the yoke with ribs of FIG. 16 along the line M—M.

FIG. 17 shows an end view of a V-type slide as shown in FIG. 16.

FIG. 24 shows a partial view of a yoke with arcuate surface to engage a sliding block with offseet center of curvature, with a slide to receive a T member guide mounted to the crankcase.

FIG. 25 shows a bottom view of the slide and attendant guide of FIG. 24.

FIG. 26 shows a partial view of a yoke having a rectilinear planar surface for the sliding block substantially orthogonal to the cylinder axis and having a slide to receive a T guide mounted to the crankcase.

FIG. 27 shows a yoke for use in a V engine and having a arcuate surface for the sliding block, without offset from the axis serving as a center line for the V, and having a T slide mounted on opposite arms of the yoke.

FIG. 28 shows a bottom view in section of the T slide of FIG. 27 disclosed with a cross-section of a guide mounted to a crankcase wall.

FIG. 29 shows a yoke for a V engine having a rectilinear surface for the sliding block substantially orthogonal to the center of the V and having T slides on opposite arms of the yoke.

FIG. 30 shows a partial view of a yoke for a V engine having a planar surface for the sliding block and having slides which receive T members each mounted to an opposite side of the crankcase.

FIG. 31 shows a partial view of yoke for a V engine having a curvilinear surface for a sliding block substantially without offset from the center line of the V and having slides which receive T members mounted to opposite sides of the crankcase.

FIG. 32 shows an end view of a plate for a sliding block having a curvilinear slot for a yoke.

FIG. 33 shows a front view of a plate employed on an arcuate slotted sliding block.

FIG. 34 shows a front view of another embodiment of a plate employed on a sliding block.

FIG. 35 shows an end view of a plate of FIG. 34.

FIG. 35A shows an end view of a plate for a sliding block having a rectilinear slot.

FIG. 36 shows a side view of a sliding block with extended bearing surfaces.

FIG. 37 shows an end view of a sliding block according to FIG. 36.

FIG. 43 shows a prior art guide adjusting device.

DISCUSSION OF THE PRIOR ART

Figures 1, 2, 3, 8:
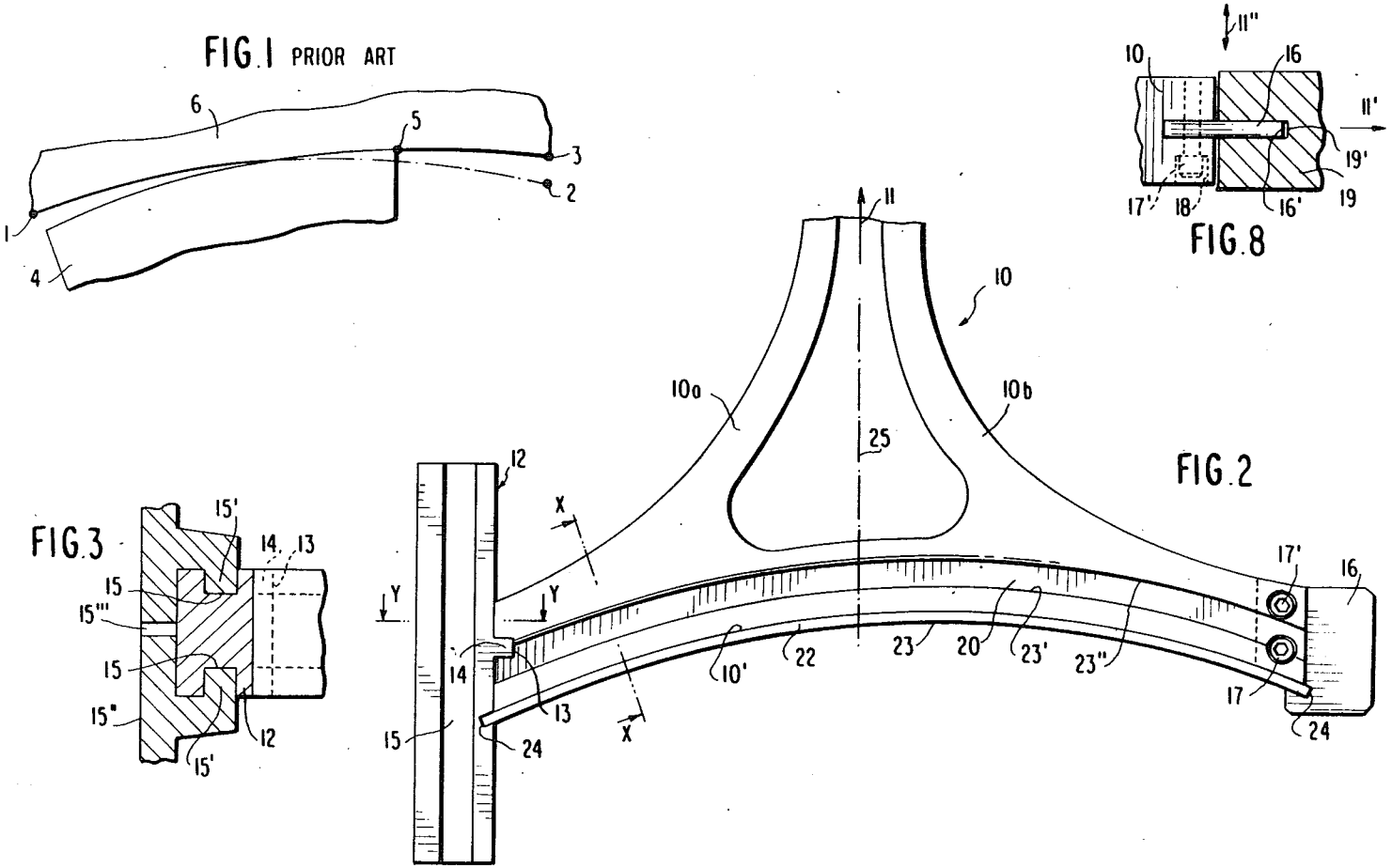
FIG. 1 PRIOR ART
FIG. 1 is a schematic diagram showing operation of a prior art device.
FIG. 2 shows a scotch yoke with offset arcuate surface for a sliding block with slides to engage guides on crankcase walls and sliding block, according to an embodiment of the invention.
FIG. 3 shows a cross-section of a crankcase guide and yoke slide along the line Y—Y as disclosed in FIG. 2.
FIG. 8 shows a top view of a fin slide mounted to a yoke with guide mounted to a crankcase.

FIG. 1 shows a schematic diagram of a portion of an arcuate or curvilinear sliding block according to the prior art, for example, Jayne et al. U.S. Pat. No. 4,584,972. The sliding block 4 is shown as originally shaped to have a curve matching the curve shown in construction lines by the arc 1-2. During operation, expansion due to heat in the cylinder may cause the sliding block 4 to increase its dimensions imposing a load on the surface of the yoke with arcuate or curvilinear surface described by the arc 1-2 such that slot, after a time, assumes a configuration shown by the arc 1-3. This may create play between the block 4 and the yoke 6 so that the sliding block tends to become cocked with regard to the worn yoke surface 1-3 and a wedging action known in the art as the "bureau drawer" effect may occur such that the point 5 of the sliding block 4 abrades the surface of the yoke 6 to further increase the wear as the sliding block 4 reciprocates within its curvilinear slot. The other corners of the sliding block, of which there are 4 with attendant bearing surfaces may, in similar fashion, abrade the surface of the yoke 6 as the yoke 6 and sliding block 4 reciprocate.

Manifestly, such wear with attendant play is undesirable both from the standpoint of noise, energy loss and machine damage.

DETAILED DESCRIPTION OF THE INVENTION

FIG. 2 shows a yoke designated generally by 10 which is connected to a piston, not shown, positioned substantially centered on cylinder axis 25 in the direction of the arrow 11. A first slide 12 is mounted to yoke arm 10*a* of the yoke 10 by means of a recess 13 which receives a land 14 which extends from the inner side of the slide 12. The engagement of recess 13 with land 14 assures a fixed vertical relation between yoke arm 10′ and slide 12. Slots 15 in the slide 12 are present to receive lands 15′, as shown in FIG. 3, of a guide mounted to the crankcase wall 15″.

Arcuate or curvilinear slot 20 is bounded by surfaces 23′ and 23″ serving to contain a land of a sliding block, not shown.

A lubrication hole 15''' allows input of lubricant to the respective surfaces of the yoke slide 12 and attendant lands 15' of the crankcase guide.

A second slide 16 configured essentially as a fin is bolted to a second arm 10*b* of the yoke 10 by means of bolts 17 and 17'.

As seen in FIG. 8, a recess 18 accepts the head of the bolt 17', the bolt 17' being tapped into the structure of the yoke 10. Slide 16 is received in a slot in a U-shaped second guide 19 mounted to the opposing wall of the crankcase. The configuration of the slot 10 is designed to afford significant space between the face 16' of slide 16 and the base 19' of the guide 19 to allow for expansion of slide 16 under operating conditions in the direction of the arrow 11'. The yoke is retained within the slot in the guide 19 with little or no lateral movement in the direction of the arrow 11''.

It will thus be seen that the yoke 10 has a first degree of freedom of movement in the direction of the arrow 11, FIG. 2, a second degree of freedom of movement for expansion in the direction of the arrow 11' but virtually no degree of freedom of movement in the direction of the arrow 11''.

It will be observed that the curvilinear surface 23 of the bearing member 22, FIG. 2, has a radius of curvature, the center for which is offset from the cylinder axis 25 of the yoke 10.

FIG. 4 shows a cross-section of one arm of the yoke 10 as disclosed along the line X—X in FIG. 2. Slots 20 are recessed in the body of the yoke 10 which is enlarged at 21 to increase the strength of the yoke 10. Slots 20 accept ridges or lands of a sliding block, not shown. A bearing insert member 22 is seated against the extremity of the yoke 10 at 10*c*. The bearing surface 23 of the bearing insert member 22 accepts a face of a sliding block. The bearing insert member 22 is received in a notch 24 in slides 12 and 16, FIG. 2. The seating of the bearing insert member 22 within the slots 24 may be under compression thereby to fix the position of the bearing insert member 22.

FIG. 5 shows a cross-section of the yoke 10 with a bearing insert member 22 seated at surface 10' engaging a surface 23 of a land 4' of a sliding block 4. Matching V surfaces at 4'' of the sliding block 4 and yoke 10, respectively, serve as keystone bearing surface to center and position the yoke 10 with respect to the sliding block 4.

FIG. 6 shows a cross-section of the yoke 10 with sliding block 4 by having a configuration opposite to that of FIG. 5 in that the keystone bearing is effected by a land 10*d*, part of yoke 10, engaging in sliding relationship the guide surfaces at 4'' of the sliding block 4 to effect the keystone effect.

FIG. 7 shows a cross-section of the yoke 10 having a T configuration, with a bearing insert member 22 presenting a surface 23 to engage a sliding block the yoke 10 providing second surface 23' to engage a surface of the sliding block.

FIG. 9 shows a perspective view of the slide 16 of FIGS. 2 and 8 showing the notch 24 for receiving and fixing the position of the bearing insert member 22, and holes 17'' and 17''' for the receiving bolts 17 and 17' respectively to mount the slide 16 to yoke 10.

The yoke 10 shown in FIG. 10 is essentially similar to that shown in FIG. 2 but has a curvilinear surface of the bearing member 22, the center of the radius of curvature being substantially coincident with the cylinder axis 25.

Figure 11:
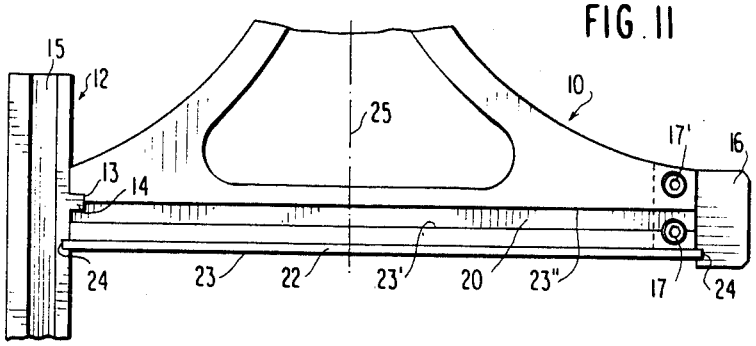
FIG. 11 shows a yoke with slides according to the invention wherein the surface of the yoke engaged by the sliding block is substantially rectilinear and substantially orthogonal to the axis of the cylinder.

FIG. 11 shows a yoke 10 essentially similar to that of FIG. 2 but which admits of a sliding block, not shown, moving substantially orthogonally with respect to the axis 25 in a rectilinear fashion.

The surfaces 23, 23' and 23'' and the opposing surfaces in the slots 15 are, respectively, close together thereby facilitating precision machining. The same is true of the opposing sides of slide 16 and the opposing sides of slot 19 which engage the sides of slide 16.

It will be appreciated from a consideration of FIGS. 2 to 11, and also from the description of the figures that follow that the yoke and attendant structure, configured according to the invention, serve to couple or to lock a first arm of the yoke to one wall of the crankcase admitting of little or no displacement of the arm so engaged laterally with respect to the one wall during the sliding or reciprocation of the yoke as the crankshaft rotates, at the same time allowing lateral displacement of the second arm of the yoke with respect to a second wall of the crankcase opposite the first wall, the lateral displacement of the second arm of the yoke being contained by the slot within which fin slide 16 rides, and in addition, the sliding block is coupled or locked to the yoke during the sliding of the sliding block with respect to the yoke as the yoke and crankshaft move through their respective cycle.

The simplicity of the components of the invention make rebuilding and retrofitting engines less expensive inasmuch as grinding of the guide and slide surfaces may be made in a single pass and with a single tool set-up.

Because of the coupling of the sliding block to the yoke 10 in the manner contemplated by the invention, the mass of the yoke may be reduced for the reason that it is not necessary to contain the sliding block within the yoke. This results in a reduced mass necessary for the yoke, at the same time reducing the distances between the surfaces 10', 23' and 23'' which must be machined during manufacture. The end result is a yoke manufactured with greater precision of less mass for a given expense in manufacture as compared with the prior art.

Figure 12:
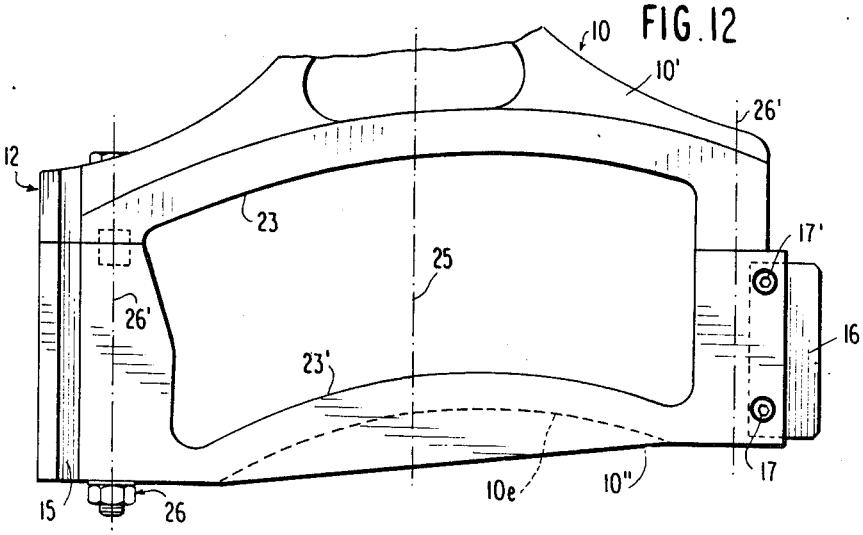
FIG. 12 shows a yoke having an enclosed sliding block, with arcuate surfaces having a center of curvature offset from the axis of the cylinder.

FIG. 12 shows a yoke 10 having a curvilinear slot bounded by surfaces 23 and 23' wherein the center for the radius of curvature is offset with respect to the axis 25. A slide designated generally by 12 has slots 15, one on each side of the yoke 10 as seen, for example, in FIG. 3 each extending across the members 10' and 10''. The yoke 10 is comprised of an upper member 10' and a lower member 10''. Lower member 10'' is bolted, or otherwise fixed, to the upper member 10' at opposite ends of the members 18' and 10'' by bolts such as 26 schematically shown by the construction lines 26'. The two slots 15 receive members 15', see for example, FIG. 3, which members 15' are mounted to the crankcase wall 15''. Fin slide 16 is bolted to the yoke 10 by means of bolts 17 and 17' as described in connection with FIG. 2 above. Dashed line 10*a* represents a surface of a recess in the lower member 10'' of the yoke which serves as a mass reduction feature.

Figure 13:
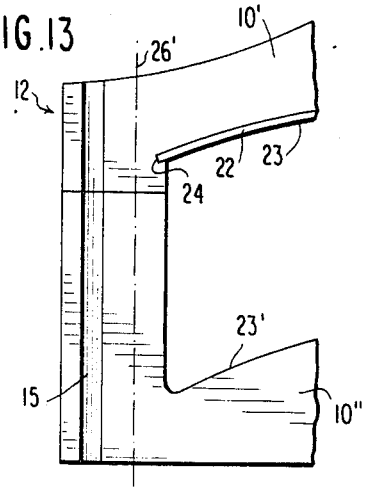
FIG. 13 shows a partial view of a yoke with enclosed sliding block with surfaces having a center of curvature substantially coincident with the axis of the cylinder.

FIG. 13 shows a partial view of a yoke 10 essentially similar to that of FIG. 12 having an upper member 10' with a curvilinear bearing insert member 22 with a bearing surface 23 received in slots 24 of the upper member 10' and with a lower bearing member 10'' with matching curvilinear surface. A fin slide 16, not shown, but see for example FIG. 12, is mounted on the yoke arm remote from the slide 12. The curvilinear surfaces 23 and 23' of FIG. 13 each have a center of curvature which is substantially coincident with an axis such as 25 as in FIG 12.

Figure 14:
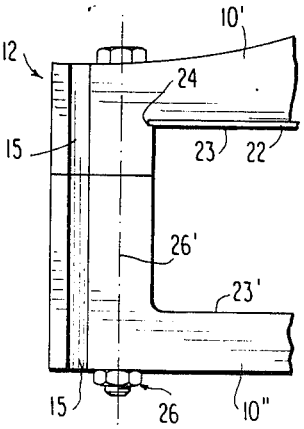
FIG. 14 shows a partial view of a yoke with a substantially rectilinear slot substantially orthogonal with respect to the axis of the cylinder.

FIG. 14 shows a partial view of a yoke 10 essentially similar to that of FIG. 12 with for a rectilinear slot orthogonal to an axis such as 25 in FIG. 12. For FIG. 14, as shown in FIG. 12, a fin slide 16 is mounted to the lower yoke member 10" by bolts 17 and 17".

In FIGS. 12 to 14, the lower member 10" serves to couple the sliding block to the yoke 10.

It will be appreciated that in FIGS. 2, 8, 10–14, that the slot which receives the fin slide 16 has space to allow for expansion in a direction substantially orthogonal to the axis 25 so that during operation, if expansion of the yoke occurs, the fin slide 16 will enter the space shown in FIG. 8 at 19' without causing jamming or distortion of the yoke 10.

FIG. 15 shows a partial view of a yoke 10 according to the invention wherein both arms (only arm 10*a* is shown) of the yoke 10 have substantially identical configurations, a curvilinear bearing insert member 22 with a curvilinear surface 23 is received in slides 30 on each side of the yoke 10 at notches 24. A notch 13 accepts a land 14 to prevent vertical displacement of the slides 30 with respect to the yoke 10. The slides 30 are configured in cross-section as V slides with surfaces of the V defined by a edge 31 and an edges 32, as shown in FIG. 15A. The V slide is received by a member 33, as shown in FIG. 15A, which member is mounted to the crankcase wall, not shown. By means well known to those skilled in the art, at least one of the members 33 may be made adjustable in the direction orthogonal to the axis 25 so that the play between the slides 30 and their attendant guides 33 may be adjusted for appropriate clearance.

This may be accomplished by any of a variety of prior art expedients in a manner such that the member 33 will maintain the yoke 10 and attendant structure in substantial alignment with the axis of movement of the yoke at the same time affording a fit of yoke and crankcase for proper operation of the engine. An example of such a prior art structure is shown in FIG. 43 which shows in schematic form with dimensions exaggerated for the purposes of illustration, guide member 33 mounted to a support 304 with an extension 304' slotted to a depth shown by dotted line 305 to receive the neck 306' of a bolt 306. The head of the bolt and shoulder 306" ride on the top and bottom of the slotted extension 304'. Bolt 306 is tapped into the threaded hole 307 of member 302 which in turn is mounted to crankcase wall 301. Surfaces 303 and 303' are configured, for example, as keystone ways such that, as bolt 306 is advanced or retracted in tapped hole 307, member 304 will ride up and down the keyed ways 303 and 303' causing member 304 with extension 304' to move to the right or left as shown by arrow 309. Extension 304' moves in relation to the bolt 306 by virtue of the slot, the depth of which is indicated by 305. Member 304 thereby moves guide 33 towards or away from the crankcase wall 301, carrying with it the slide 30, 31 which engages guide 33, together with the yoke 10.

The center of curvature of the bearing surface 23 in FIG. 15 has substantially no offset with respect to the axis 25, as shown in FIG. 15.

In FIG. 16 the yoke 10 is essentially similar to that of FIG. 15 except that the curvilinear surface 23 has a center of curvature which is offset with regard to the axis 25. The V slides 30 in FIG. 16 are shown to be attached to the yoke 10 by means of bolts 35, the heads of which are recessed into the slides 30. As shown in FIG. 16A, reinforcement of the yoke 10 may be affected by ribs 34.

FIG. 17 shows an end view of the slides 30 with the bolts 35 and their attendant recesses 35' for the bolt heads.

Figure 18:
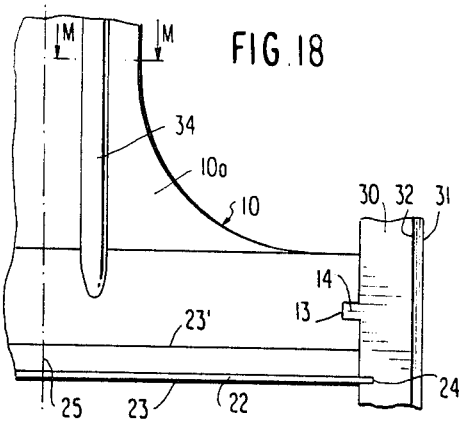
FIG. 18 shows a partial view of V slides at both extremities of the yoke arms with a rectilinear surface for the sliding block orthogonal to a cylinder axis.

FIG. 18 shows a partial view of a yoke essentially similar to that of FIG. 15 wherein the sliding block engages rectilinear surface 23 orthogonal to a cylinder axis. As with FIGS. 15 and 16, both arms (only 10*a* is shown) of yoke 10 have substantially identical configurations.

Figure 19:
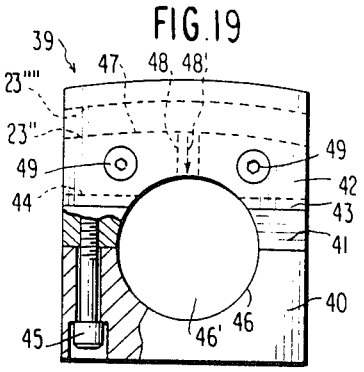
FIG. 19 shows a sliding block with arcuate surfaces.
Figure 20:
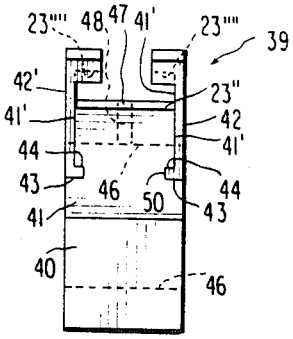
FIG. 20 shows an end view of the sliding block of FIG. 19.

FIGS. 19 and 20 show a sliding block, designated generally by 39, for a yoke 10 having a curvilinear bearing surface such as those shown in FIGS. 2, 10, 15 and 16, for example. Sliding block 39 comprises a lower block member 40 and an upper block member 41. The lower block member 40 is mounted to upper block member 41 by means of bolts 45, the heads of which are recessed in the lower block member 40 and tapped into the upper block 41. The sides of upper block member 41 are recessed at surfaces 41' to receive plates 42 and 42' mounted on opposing sides respectively of the upper block 41. The lower extremity at 43 of the plates 42 and 42' engages a notch in upper block member 41 on each side which admits rail 44 to anchor the respective plates 42 and 42' to the upper block member 41. Bolts pass through the plates 42 and 42' tapped to upper block member 41 there between along the axis 49 to anchor the plates 42 and 42' to the upper block member 41. Other fastening means may be employed in lieu of bolts as will be apparent to those skilled in the art. Dashed line 23''' represents a surface 47 of the upper block member 41 which engages the bearing insert member 23, for example as shown in FIG. 16 for example. Dashed lines 23'''' designate surfaces which serve to engage bearing surface 23' of FIG. 16. The sliding block 40–41 is thus coupled to the yoke 10, as shown in FIG. 16, by virtue of the surfaces 23''' of upper block member 41 and 23'''' of the plates 42 and 42'. While explained in connection with FIG. 16, it will be appreciated that the locking action between sliding block 39 and yoke 10 described is also present in the structures of FIGS. 2, 10–12, 15, 16, 20, 21, 23, 24, 26, 27, 29–32.

The sliding block 39 has been described in connection with the arcuate slot yoke such as that shown in FIG. 10 wherein the center of curvature of the slot is substantially coincident with the cylinder axis, it will be appreciated that, according to the invention, sliding blocks for arcuate slots with offset centers of curvature, see FIG. 2 for example, will have the surfaces 23''' and 23'''' and attendant structure configured to mate with the offset slots of the yoke. Similarly, sliding blocks for yokes having rectilinear slots, such as shown in FIG. 11, will have surfaces comparable to 23''' and 23'''' and attendant structure configured to mate with the rectilinear slots of the yoke.

Bearing inserts, not shown, of construction well known to those skilled in the art, are introduced to the bearing 46 for containing the crank throw 46', FIG. 19, of the crank shaft of the engine. The bearing inserts are of conventional construction and may contain a hole which may register with the hole designated by the dashed lines 48. Accordingly, lubrication may be transmitted by holes in the crank throw conventional in the art, through the hole in the bearing insert, not shown, to the hole 48 to transmit lubrication to the bearing surfaces 23 and 23' and 23''' and 23''''.

Alternatively, lubricating holes in the crankshaft and crankthrow may be omitted and accordingly, the crankthrow surface may be lubricated by introduction of lubricant in the direction of the arrow 48' in a manner to be explained subsequently.

Figure 21:
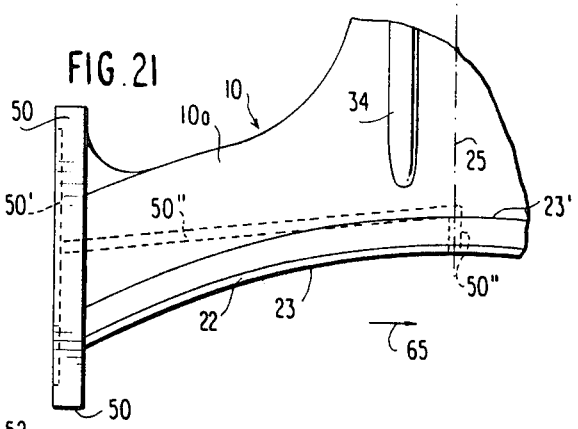
FIG. 21 shows a partial view of a yoke with lubrication channels and T cross-section arcuate slot without offset and with T cross-section slide to engage a crankcase wall guide.
Figure 22:
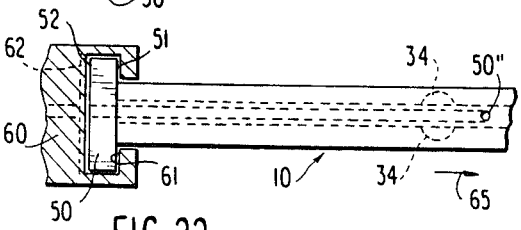
FIG. 22 shows a bottom view of the yoke according to FIG. 21.

FIGS. 21 and 22 show partial views of a yoke 10 according to another embodiment of the invention wherein a T slide 50 is provided at the end of an arm of the yoke 10. Arm **10*b*, not shown, is substantially identical to arm 10*a* but may or may not have lubricating bores 50' and 50''. As shown in the bottom view, FIG. 22, for example, the bearing surface 23 abuts the bar 50 of the T slide, the latter being received by a guide 60, FIG. 22, which is mounted to the wall of the crankcase, not shown. Surfaces 51 and 52 of bar 50 are provided with clearance between the surfaces 61 and 62 of the guide 60. Lubrication channel 50' and bores 50'' will be described subsequently. The configuration is shown in FIG. 21 for an arcuate slide 22, 23 and 23' of the yoke 10**.

Figure 23:
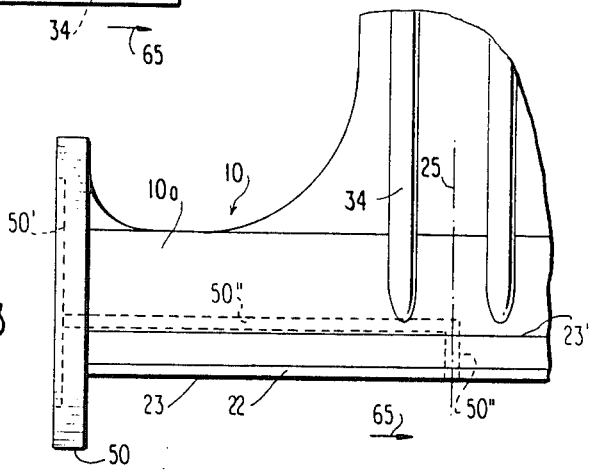
FIG. 23 shows a partial view of a yoke with T slide surfaces to engage a sliding block and T slides at an extremity of both yoke arms.

In a similar fashion, FIG. 23 shows a partial view of a T slide 50 for a yoke 10 having a planar-linear slide 22, 23, 23' for the sliding block, the T slide 50 being configured for engaging within a guide such as 60 as shown in FIG. 22.

The right arm extension of the yoke for FIGS. 21, 22 and 23, not shown but located in the direction of the arrow 65 may have a slide comparable in configuration to the T bar slide 50, 51, 52 as shown in FIGS. 21, 22 and 23. In such a configuration at least one of the guides 60 may be mounted to the wall of the crankcase for lateral positioning adjustment well known to those skilled in the art as previously expalined.

Alternatively, the yoke arm has a fin slide such as that shown in FIG. 2 at 16, see also FIGS. 8 and 9.

FIG. 24 shows a partial view of a curvilinear yoke with offset center of curvature wherein a T bar guide 80 is mounted to the wall of the crankcase, not shown, the T bar guide 80 being received between the surfaces 71 and 72 of a mating slide 70 mounted to the yoke. FIG. 25 shows a partial bottom view of the yoke 10 shown in FIG. 24. In FIG. 25 the T bar guide is disclosed at 80 with the surfaces 81 and 82 being received between the mating surfaces 71 and 72 of the slide 70 mounted to the yoke 10. Dotted line 24, in FIG. 25, designates the position of bearing member 22 in a notch in the slide 70 to assure the fixing of the position of the bearing member 22.

FIG. 26 shows a yoke 10 essentially similar to that of FIG. 24 but for receiving a sliding block which moves in linear fashion.

Both arms of yoke 10 as shown in FIGS. 24, 25 and 26 may have substantially identical configurations, and the attendant guides 80, on at least one side may be adjustable orthogonal to the axis 25 by means well known.

Alternatively, a fin slide 16 may be mounted to the opposite arm of the yoke, the slide 16 being received in a guide 19 mounted to the wall of the crankcase, as shown in FIG. 8.

FIGS. 27, 28 and 29 show yokes for use with a V engine.

Connecting rods 90 and 90' as shown in FIG. 27 are mounted to the yoke 10 by wrist pins 91 and 91' having centers at 92 and 92' respectively.

The connecting rods 90 and 90', in the direction of the arrows 90'', are connected respectively to pistons positioned in cylinders, each cylinder being in one of the opposing arms of the V defined by axis lines 90'''.

FIG. 27, employs a curvilinear slot, without offset of the center of curvature, for the sliding block the slot being configured, for example, as in FIG. 4 with the slot 20 having sides 23' and 23''. A bearing insert member 22 has a bearing surface 23 which engages the sliding block, a second bearing surface of the yoke 10 engaging the block being 23'.

FIG. 29 shows a yoke 10 for a V engine having a rectilinear slot 20 for a sliding block connecting rods and pistons being connected as explained in connection with FIG. 27.

As shown in FIG. 28, the yokes 10 of FIGS. 27 and 29 have T bar slides 50 with a neck 50' which connects to the yoke 10 at shoulders 53.

It will be observed, in FIG. 28, that the bearing surface 23 has a width comparable to the width of the guide 60 shown in cross-section, the guide 60 being attached, as previously described, to the wall of the crankcase, not shown.

While FIGS. 27 and 29 show a slot 20 for a sliding block configured in accordance with FIG. 4, it will be appreciated that the yoke and sliding block may employ one of the configurations shown in FIGS. 5–7.

FIGS. 30 and 31 show partial views of yokes 10 for employment in a V engine, FIG. 30 being for a sliding block operating in a rectilinear slot and FIG. 31 representing a yoke for a curvilinear sliding block with substantially no offset for the center of curvature. As with FIGS. 27 and 28, the slots for the sliding block are configured as shown in FIG. 4 however, as previously indicated, an alternative configuration of the yoke could be used, namely, that shown in FIG. 7 wherein the yoke is effectively a T with a bearing member 22 with a bearing surface 23 which, together with bearing surfaces 23' engage comparable surfaces of the sliding block, namely, the surface 23''' and 23'''' as shown in FIG. 18.

The two slides 70, as shown in FIGS. 30 and 31 are slotted each to receive a T bar guide such as 80 of FIG. 25, the T bar guide being mounted to an opposite wall of the crankcase as shown, for example, in FIG. 25, at least one such guide being adjustable laterally with respect to the direction, see arrow 25', of movement of the yoke 10. The opposite arm **10*b* not shown in these figures may be substantially identical to arm 10*a*, at least one of the arms being mounted for adjustment in the manner shown in FIG. 43**.

In an alternative embodiment of FIGS. 27 to 31 one of the slides of the yoke 10 for a V engine is configured as fin slide 16, as shown in FIGS. 2, 10 and 11, which is received in a slot 19' of a guide 19 mounted to the wall of the crankcase as shown in FIG. 8.

It will be appreciated that the fin slide 16 of FIG. 2 with attendant guide 19 mounted to one wall of the crankcase may be used on one arm of any of the yokes 10 shown in FIGS. 2, 10 to 15, 16, 20 to 31, where the second of the arms has a slide coupled to a guide mounted to an opposing wall of a crankcase in a manner shown in those figures.

FIGS. 32 and 33 show an end view and a side view respectively of the interior of the plate 42 shown in FIGS. 18 and 19. A ridge 50 defined by surfaces 43 and 44 serves to anchor the plate 42 to the upper block member 41, FIGS. 18 and 19. Surface 23'''' bears against a surface such as 23' in FIG. 16, for example. Holes 49 serve to admit bolts which pass through plate 42, the upper block member 41 and may be tapped to upper block member 41 to anchor the plate 42 to the sliding block. In this embodiment, the surface 42 of the plate is recessed between the edge 44 and the surface 23''''.

Surface 46 serves as a seat for a bearing insert, which, in turn, accepts a crank throw, also not shown, in accordance with accepted bearing insert design practice well known in the art.

Another embodiment of a plate for use with the sliding block is shown in FIG. 34 and end view FIG. 35 wherein a slot defined by surfaces 23'' and 23'''' serves to receive the yoke. The resulting plate requires less machining at the same time providing a plate by greater strength.

FIG. 35A shows an end view of a plate for a sliding block having a straight or rectilinear slot with surfaces 23'' and 23'''' for retaining the sliding block coupled in sliding relationship to the yoke.

FIGS. 36 and 37 show an embodiment of a sliding block according to the invention wherein the effectiveness in the sliding block in avoiding cocking or the "bureau drawer" effect is increased. The block shown comprising block member 40 and 42 is held together by bolts 45 tapped into 42, the members 40 and 42 encompassing the crank throw and a bearing insert within the journal bearing 46. Surface 97 of the member 42 will engage a bearing surface 23 as, for example, in FIG. 11. Surface 96 will engage a surface of the yoke such as 23' in FIG. 11. In order to reduce the tendency of the sliding block to cock or jam, the surface available for engaging the yoke is extended from point 100 to point 101 and from point 102 to point 103 thereby giving the block an effective truncated pyramidal shape which greatly reduces the tendency to jam during reciprocation.

The portion of the sliding block members 40 and 42 between lines 100 and 102 thus essentially constitute a pillow block with attendant bolts and support therefor and the portions of sliding block members 40 and 42 extending beyond the pillow block constitute pillow block extensions, the pillow block extensions serving to minimize the "bureau drawer" effect previously described.

While explained in terms of a yoke with rectilinear slots for the sliding block, the invention is contemplated as providing pillow block extensions for sliding blocks having arcuate slots such as those shown in FIGS. 2 and 10, for example.

Lubrication may be provided to the sliding block 39 and crankthrow 46' in all of the configurations of the invention described above without employing lubrication bores in the crankshaft. FIGS. 38, 39, 40 and 41 show according to the invention, lubrication supplied through the walls of a crankcase to a channel in a guide mounted thereto, thence to a channel in a slide mounted to a yoke, through bores in the body of the yoke to bearing surfaces for a sliding block for lubricating the sliding block and through a bore in the sliding block to lubricate the crankthrow. The expense of providing the channels in the crankshaft is thereby avoided.

Figure 38:
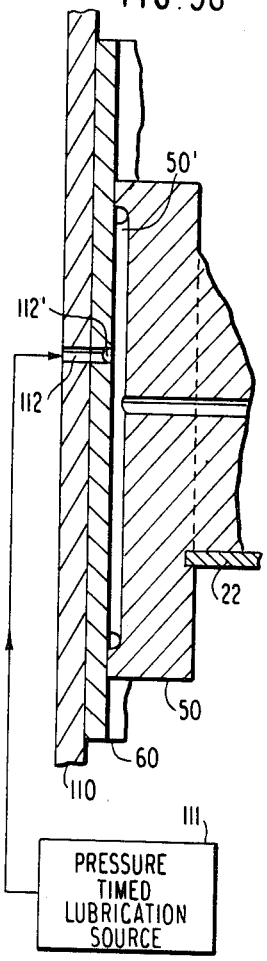
FIG. 38 shows a cross-section view of a crankcase wall, guide, slide and yoke with lubrication timing control apparatus.
Figure 39:
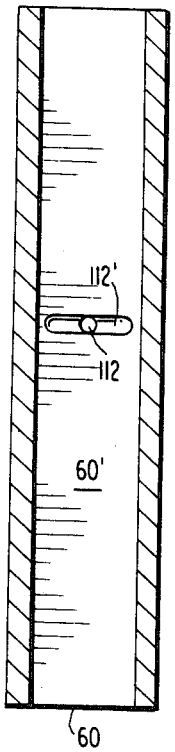
FIG. 39 shows a cross-section view of an embodiment of a crankcase wall guide.
Figure 40:
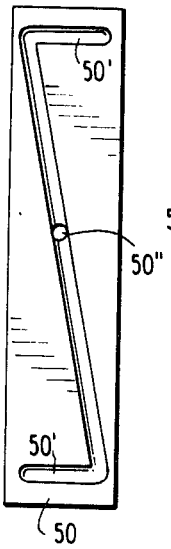
FIG. 40 shows a cross-section view of an embodiment of a yoke slide.
Figure 41:
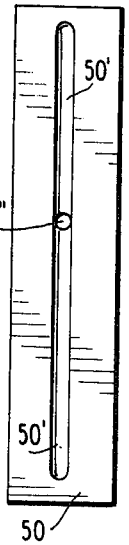
FIG. 41 shows a cross-section view of an alternative embodiment of a yoke slide.

In FIG. 38, a pressure timed lubrication source 111 serves to provide lubricant to a channel 112 in the crankcase wall 110. Lubricant proceeds through the channel 112 which passes through the guide 60 to enter channel 112' disposed across the face of the bearing surface 60' of the guide 60, see FIG. 39. It will be observed that the channel 112' does not exhaust into the crankcase proper but is essentially isolated therefrom, being in communication with channel 50' of slide 50 which is mounted to yoke 10 as shown in previous figures, see for example, FIG. 21. Channel 50' is shown in FIG. 40 as having a Z configuration, however other configurations having substantially equivalent lubrication capabilities are contemplated, Channel 50' is in communication with channel 112' throughout movement of the yoke 10 in its reciprocation during rotation of the crankshaft. The horizontal bars of the Z assure that virtually the full bearing surfaces of the slide 50 and guide 60 are serviced with lubricant throughout the stroke of the yoke 10. Channel 50' communicates with a channel 50'' interior to the yoke 10 which, as seen for example in FIG. 21, extends substantially to the central portion of the yoke 10, exiting the yoke 10 through an aperture in bearing insert member 22 to surface 23, thereby serving to lubricate the surface of the sliding block which engages surface 23. Surface 23 further communicates by way of channel 48, FIG. 18, in the direction of arrow 48' through a perforation in a bearing insert, not shown, with the bearing surface of the crankthrow 46'. The particular configuration for the channels 112, 112', 50', 50'' and 48 will be dictated by the particular configuration of the crankcase guide, yoke slide, yoke and sliding block, but in all cases lubrication is through the wall of the crankcase, not the crankshaft, and none of the channels exhaust into the crankcase proper so that lubricant pressure is not lost. In an alternative configuration, according to the invention, the channel 50' is a linear slot extending in the direction of motion of the yoke 10 as shown in FIG. 41.

While explained using FIGS. 21 to 23 and 38 to 42, the lubricating channel configurations there shown may be used in the yokes disclosed in FIGS. 2 to 18 and 23 to 31.

The guide and slide configuration shown in FIGS. 2 to 41 thus serves to isolate the lubrication channels 50, 50', 50'', 112 and 112' passing from the crankcase wall through the yoke 10, the sliding block 39 to the crankthrow 46.

In the configuration of FIGS. 12, 13 and 14, additional bores, not shown, may be provided transmitting lubrication from the upper surfaces of the sliding block 39 engaging surface 23 through the sliding block 39 to lubricate the surface 23' of the lower member 10''.

The lubricant may, by control of source 111 be under continuous pressure.

Figure 42:
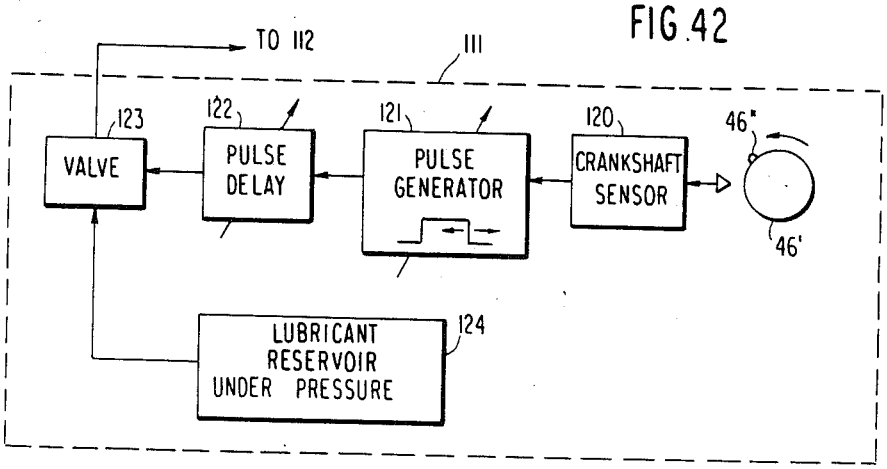
FIG. 42 shows a lubricant timing apparatus.

Alternatively according to the invention lubricant may be provided in short bursts, synchronized with the positions of the crankshaft and sliding block 39 so that a pulse of lubricant is injected at a time and for a period when pressure between sliding block 39 and crankthrow is not at a maximum, and by the same token, migration of lubricant back through the channels 48, 50'', 50', 112' and 112 may be blocked under the control of the lubricating source 111. As seen in FIG. 42, the control may be effected by element 111, employing a sensor 120 which senses the position of crankshaft 46'. This is shown schematically as a mechanical sensing of the position of a protrusion 46'' on the crankshaft 46' however it will be appreciated that electromagnetic, electrostatic, optical and other prior art means may be selected by those skilled in the art to perform this function. Sensor 120 serves to trigger a pulse generator 121 to generate a pulse, which may for example be a square wave, the width of which may be variable. The pulse width may be adjusted to establish the length of the time period desired for the lubricant pulse. The pulse output of pulse generator 121 is in timed relation to the position of the crankshaft protrusion 46''. Pulse delay element 122 serves to delay the pulse signal, adjusted to occur at a specific point in time after sensing is effected by sensor 120. By this adjustment, the timing of initiating the lubricant pulse can be set to occur as desired, for example, at a time when the position of the crankshaft 46' is such that pressure between crankshaft 46' and sliding block 40, 41, FIG. 18, is not maximum. The length of the pulse and amount of delay may be established in assembling the engine or may be made to be manually adjustable during operation by the engine operator. The output of pulse delay 122 serves to control a valve 123 located between the lubricant reservoir 124 and channel 112. Valve 123 transmits lubricant under pressure to the channel 112 in response to the timed pulse signal received from delay member 122.

From the foregoing it will be apparent that pulsed lubrication may be delivered to slides, guides, sliding block and crankthrow, timed both as to instant of initiation and duration, for example at a time of minimum load on the crankthrow, by appropriate settings of width of pulse and magnitude of delay in source 111. The circuitry for sensor 120, pulse generator 121, pulse delay 122, and the structure of valve 123 and pressure reservoir 124 may be selected from apparatus well known in the art, the details of these individual elements not being part of the instant invention.

Although the present invention has been described and illustrated in detail, it is to be clearly understood that the same is by way of illustration and example only, and is not to be taken by way of limitation. The spirit and scope of the present invention are to be limited only by the terms of the appended claims.

What is claimed:

1. An assembly for use in an engine, the engine having at least one cylinder with a piston therewithin, a yoke fixed to the piston, a crankcase with first and second opposing walls defining a crankcase volume therebetween, a crankshaft with a crankthrow within the crankcase volume, the assembly comprising means for locking together in sliding relationship elements of at least one of a configuration of yoke with sliding block and a configuration of yoke with one of said opposing walls comprising a guide means mounted to one element of one of said configurations, said guide means having at least a first surface facing outwardly from said one element towards a second surface of said one element to which said guide means is mounted, a slide means mounted to the other element of said one configuration and having at least a third surface between said first and second surfaces engaging at least one of said first and second surfaces in a manner to admit sliding therebetween, and channel means isolated from the crankcase volume throughout rotation of the crankshaft, and transmitting lubricant from an aperture in said one of the opposing walls of the crankcase via said means for locking for lubricating the crankthrow.

2. An assembly in accordance with claim 1, further comprising means for transmitting a timed pulse of lubrication to said aperture for lubricating the surface of the crankthrow at a period in time when the lubrication pressure between the yoke and sliding block is less than maximum.

3. An assembly for coupling a yoke having a yoke body, a crankcase and a crankthrow in an engine, the assembly comprising guide means mounted to a wall of the crankcase having a guide surface facing towards the wall, slide means mounted to the yoke having a slide surface facing towards said yoke body and engaging said guide surface for coupling the yoke to the guide means and allowing the yoke to slide with respect to the guide means, and sliding block means coupled to a surface of the yoke for allowing the sliding block to slide with respect to the yoke and mounted for rotation with respect to the crankthrow.

4. An assembly in accordance with claim 3, wherein the yoke comprises a yoke surface facing towards the yoke body, and the sliding block comprises a block surface facing towards the crankthrow and engaging the yoke surface to couple the sliding block and the yoke in sliding relationship.

5. An assembly in accordance with claim 3, wherein the engine comprises at least plural cylinders having respective intersecting axes to form a V configuration, at least one piston in one of said cylinders, and means connecting the yoke to said piston for relative movement between the yoke and piston.

6. An assembly according to claim 3, further comprising bearing surface means mounted under compression against the yoke and disposed between the yoke and the sliding block means.

7. An assembly according to claim 3, wherein the yoke has a motion axis and the slide means further comprises anchor means fixing the slide means to the yoke for preventing movement of the slide means with respect to the yoke in a direction substantially parallel to said motion axis.

8. An assembly according to claim 7, wherein the slide means comprises one of a recess and a land to be received by a recess and the anchor means comprises the other of said recess and said land to be received within the recess for preventing movement of the slide means relative to the yoke.

9. In an engine with a yoke having a yoke body and a bearing surface mounted to the yoke, the engine having a crankshaft, the crankshaft having a crankthrow, the improvement comprising a sliding block with an aperture therein for containing said crankthrow, the sliding block having at least one coupling surface disposed substantially to face towards the aperture for engaging in sliding relationship said bearing surface.

10. An assembly for use in an engine having a crankthrow and yoke means, the yoke means comprising a yoke body and a bearing surface facing towards the yoke body, the assembly having a sliding block comprising a member encompassing at least a portion of said crankthrow and having at least one coupling surface engaging said bearing surface.

11. In an engine having a crankcase with at least one crankcase wall and a first bearing surface mounted to said wall, the engine further comprising a crankshaft within said crank case, the crankshaft having at least one crankthrow with a sliding block rotatably mounted on said at least one crankthrow, the sliding block having at least one second bearing surface, the improvement comprising a yoke having a yoke body and comprising at least one coupling surface mounted to said yoke and substantially facing towards said yoke body and disposed to engage in sliding relationship one of (a) said first bearing surface and (b) said second bearing surface wherein said second bearing surface is at a location between the body of the yoke and the crankthrow.

12. An improvement in accordance with claim 11, wherein the yoke further comprises at least a second coupling surface mounted to said yoke and substantially facing towards said yoke body and disposed to engage in sliding relationship the other of said first bearing surface and said second bearing surface.

13. An improvement in accordance with claim 12, the yoke further comprising a third surface for engaging said crankcase wall, a fourth surface for engaging said sliding block, and a lubricating channel means for interconnecting said third and fourth surfaces.

14. An assembly for use in an engine having a crankcase with plural walls, comprising a yoke, means for coupling the yoke to a single wall of the crankcase in sliding relationship having substantially only a single degree of freedom of movement comprising a first surface mounted to and facing towards said single wall and a second surface mounted to and facing towards said yoke, the second surface engaging the first surface.

15. An assembly for use in an engine having at least a crankcase wall of plural faces, a yoke and sliding block mounted to a crankthrow, comprising slide means mounted to the yoke for slideably engaging at least one face of the crankcase wall, slide means mounted to the sliding block for slideably coupling the yoke to the sliding block, and means for delivering lubrication to a surface of the crankthrow from the crankcase wall via the yoke.

16. Sliding block apparatus for an engine comprising a block with plural sides, an aperture of substantially cylindrical configuration within the block and connecting two of said plural sides, at least a one coupling surface on a third side of said block facing substantially towards the aperture, and at least one bearing surface on said block facing substantially towards said at least one coupling surface and away from the aperture and disposed on the third side of the block between the aperture and the at least one coupling surface.

17. Apparatus in accordance with claim 16, further comprising a second coupling surface on said third side of said block facing substantially towards said aperture and spaced from and in substantially the same direction as the at least one coupling surface, the bearing surface lying substantially between the two coupling surfaces and the aperture, the bearing surface being substantially equidistant from the coupling surfaces.

18. Apparatus in accordance with claim 16, wherein the block is comprised of at least two detachable parts and each detachable part comprises a coupling surface and means for locking the said at least two detachable parts to prevent relative movement therebetween.

19. Apparatus in accordance with claim 16, further comprising a yoke having surfaces in surface to surface engagement with said bearing surface and with said at least one coupling surface to couple the yoke to the block for sliding movement relative to the yoke.

20. Apparatus in accordance with claim 19, wherein said yoke has a direction of movement, said yoke further comprising a yoke positioning means, said apparatus further comprising a crankcase, a crankcase wall with a crankcase wall positioning means coupled to said yoke positioning means to permit relative sliding movement of said yoke with respect to said crankcase wall in a single degree of freedom substantially in the direction of movement.

* * * * *